US009601887B2

(12) United States Patent
Chung et al.

(10) Patent No.: US 9,601,887 B2
(45) Date of Patent: Mar. 21, 2017

(54) SWITCHING MODULE AND ELECTRONIC DEVICE

(71) Applicant: PHISON ELECTRONICS CORP., Miaoli (TW)

(72) Inventors: Hung-I Chung, Hsinchu County (TW); Chang-Chih Chen, Hsinchu County (TW); Hung-En Huang, Miaoli County (TW)

(73) Assignee: PHISON ELECTRONICS CORP., Miaoli (TW)

( * ) Notice: Subject to any disclaimer, the term of this patent is extended or adjusted under 35 U.S.C. 154(b) by 36 days.

(21) Appl. No.: 13/922,259

(22) Filed: Jun. 20, 2013

(65) Prior Publication Data

US 2014/0335709 A1 Nov. 13, 2014

(30) Foreign Application Priority Data

May 7, 2013 (TW) ..... 102208431 U

(51) Int. Cl.
*H01R 31/06* (2006.01)
*H01R 13/635* (2006.01)

(52) U.S. Cl.
CPC ..... *H01R 31/06* (2013.01); *H01R 2201/06* (2013.01)

(58) Field of Classification Search
CPC ..... H01R 24/84; H01R 31/06; H01R 27/00; H01R 13/635; Y10S 439/945; A45C 2011/188; H05K 5/0282; H05K 5/0291
USPC .. 439/172, 166, 171, 175, 282, 528, 620.21, 439/620.22, 38, 945, 660, 638, 284
See application file for complete search history.

(56) References Cited

U.S. PATENT DOCUMENTS

| | | | | |
|---|---|---|---|---|
| 6,733,329 | B2 * | 5/2004 | Yang | 439/518 |
| 6,991,483 | B1 * | 1/2006 | Milan et al. | 439/171 |
| 7,018,227 | B2 * | 3/2006 | Takahashi | 439/347 |
| 7,296,098 | B2 * | 11/2007 | Shih | 710/13 |
| 7,479,042 | B2 * | 1/2009 | Chen | 439/660 |
| 7,575,481 | B1 * | 8/2009 | Liu | 439/660 |
| 7,632,118 | B2 * | 12/2009 | Herlitz et al. | 439/166 |
| 7,866,996 | B2 * | 1/2011 | Achsaf et al. | 439/159 |
| 8,845,366 | B2 * | 9/2014 | Brown et al. | 439/620.01 |
| 2010/0123006 | A1 * | 5/2010 | Chen | 235/441 |

(Continued)

OTHER PUBLICATIONS

"The USB Flash Drive with Adapter for Smartphone and Tablet", Mar. 31, 2013, gadgetsin.com.*

(Continued)

*Primary Examiner* — Amy Cohen Johnson
*Assistant Examiner* — Matthew T Dzierzynski
(74) *Attorney, Agent, or Firm* — Jianq Chyun IP Office

(57) ABSTRACT

A switching module including a body, a first interface assembly, and a second interface assembly is provided. The body has a first end and a second end opposite to each other. The first interface assembly is disposed at the first end. The second interface assembly is disposed at the second end and electrically connected to the first interface assembly. An electronic device including the switching module and a storage unit is provided. The switching module has a first interface assembly and a second interface assembly electrically connected to each other. The storage unit has a third interface assembly, wherein the third interface assembly is electrically connected to the first interface assembly through the second interface assembly.

11 Claims, 10 Drawing Sheets

(56) References Cited

U.S. PATENT DOCUMENTS

| | | | | |
|---|---|---|---|---|
| 2010/0259399 | A1* | 10/2010 | Tanno | 340/635 |
| 2012/0309231 | A1* | 12/2012 | Nguyen et al. | 439/620.22 |
| 2014/0057495 | A1* | 2/2014 | Liao et al. | 439/660 |
| 2014/0199888 | A1* | 7/2014 | Brown et al. | 439/620.01 |

OTHER PUBLICATIONS

TechFresh.net, "Sanwa USB Card Reader Dock", Mar. 23, 2012, <http://www.techfresh.net/sanwa-usb-card-reader-dock/>.*

* cited by examiner

SWITCHING MODULE AND ELECTRONIC DEVICE

CROSS-REFERENCE TO RELATED APPLICATION

This application claims the priority benefit of Taiwan application serial no. 102208431, filed on May 7, 2013. The entirety of the above-mentioned patent application is hereby incorporated by reference herein and made a part of this specification.

BACKGROUND OF THE INVENTION

Field of the Invention

The invention relates to a switching module, and more particularly, to an electronic device having a switching module.

Description of Related Art

With the developments of multimedia technology, storage capacity required for digital data goes larger and larger. Conventional floppy disk in 1.44 MB features in its portable characteristic but still fails to meet the requirement of large storage capacity. Although a conventional hard disk provides a large storage capacity, it still suffers in bulk size which leads to inconvenient carrying. Recently, with the popularization of the universal serial bus (USB) interface and the reduction of the price of the flash memory, USB flash disks advantaged in large storage capacity, high compatibility and portability are broadly applied in data transmission between various computers and storage devices.

The flash disk featuring in large storage capacity, plug-and-play, compact size and portability has taken the place of the floppy disk. Generally, the flash disk is electrically connected to a computer host and a storage device through a connector (e.g., a USB plug or a IEEE 1394 plug).

But, as existing electronic devices have included a wide variety of connectors, how to improve adaptability of the flash disk has become a problem to be solved for person skilled in the art.

Nothing herein should be construed as an admission of knowledge in the prior art of any portion of the present invention. Furthermore, citation or identification of any document in this application is not an admission that such document is available as prior art to the present invention, or that any reference forms a part of the common general knowledge in the art.

SUMMARY OF THE INVENTION

The invention is directed to an electronic device, which can be connected to other electronic devices with different interface assemblies by using a switching module.

The switching module of the invention includes a body, a first interface assembly, and a second interface assembly. The body has a first end and a second end opposite to each other. The first interface assembly is disposed at the first end. The second interface assembly is disposed at the second end and electrically connected to the first interface assembly. The first interface assembly is a male connector and the second interface assembly is a female connector.

The electronic device of the invention includes a switching module and a storage unit. The switching module has a first interface assembly and a second interface assembly electrically connected to each other. The storage unit has a third interface assembly, wherein the third interface assembly is electrically connected to the first interface assembly through the second interface assembly.

In view of above, according to the electronic device of the invention, the electronic device is adaptable for other electronic devices having different interfaces by using the switching module. The switching module may be accommodated within the electronic device as an accessory to improve its portability. Further, the storage unit may also be disposed with connectors with different interfaces at the same time. In addition, the switching module is capable of being assembled and detached together with the storage unit based on actual requirements, so as to improve adaptability of the storage unit.

In order to make the aforementioned and other features and advantages of the present invention more comprehensible, several embodiments accompanied with figures are described in detail below.

It should be understood, however, that this Summary may not contain all of the aspects and embodiments of the present invention, is not meant to be limiting or restrictive in any manner, and that the invention as disclosed herein is and will be understood by those of ordinary skill in the art to encompass obvious improvements and modifications thereto.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
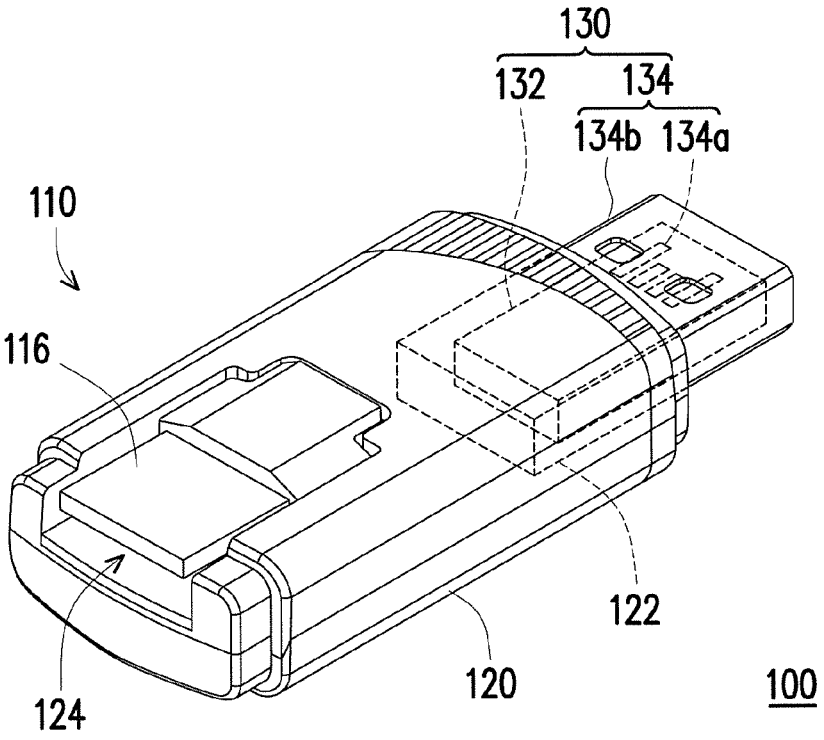
FIG. 1 is a schematic diagram of an electronic device according to an exemplary embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Embodiments of the present invention may comprise any one or more of the novel features described herein, including in the Detailed Description, and/or shown in the drawings. As used herein, "at least one", "one or more", and "and/or" are open-ended expressions that are both conjunctive and disjunctive in operation. For example, each of the expressions "at least on of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein.

Figure 2:
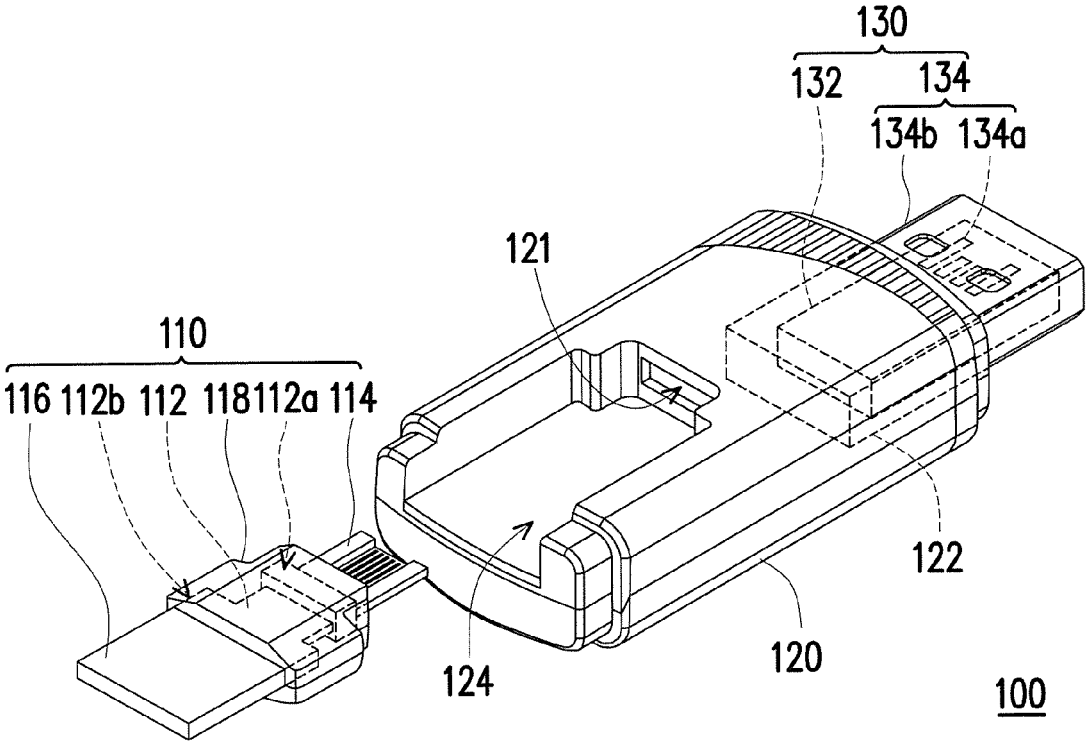
FIG. 2 is an explosion diagram of the electric device depicted in FIG. 1.
Figure 3:
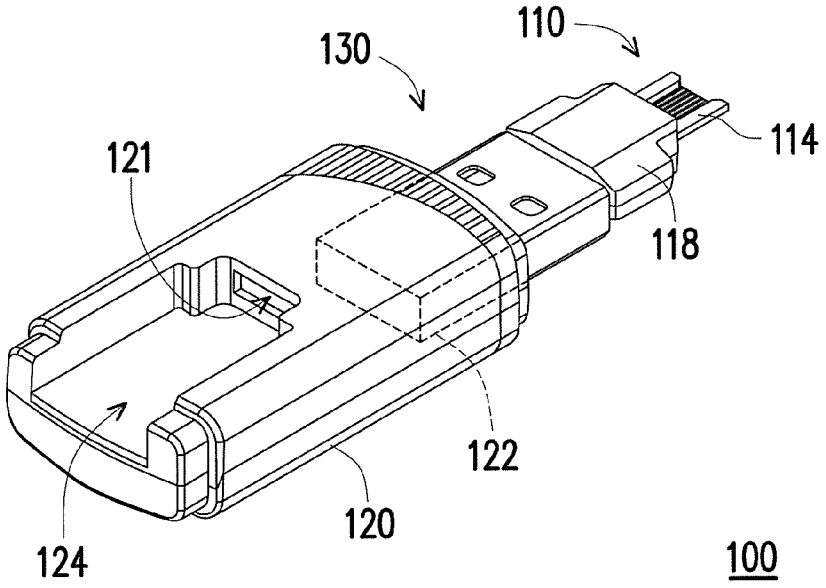
FIG. 3 is a schematic diagram of another state of the electronic device depicted in FIG. 1.

FIG. 1 is a schematic diagram of an electronic device according to an exemplary embodiment of the invention. FIG. 2 is an explosion diagram of the electric device depicted in FIG. 1. FIG. 3 is a schematic diagram of another state of the electronic device depicted in FIG. 1. Referring FIG. 1 and FIG. 3 together, in the present exemplary embodiment, an electronic device 100 is, for example, a flash disk module which includes a switching module 110, a housing 120 and storage unit 130.

The switching module 110 includes a body 112 (which will be described later, and it is only representatively illustrated herein with dotted line in FIG. 2), a first interface assembly 114 and a second interface assembly 116. The body 112 has a first end 112*a* and a second end 112*b* opposite to each other. The first interface assembly 114 is disposed at the first end 112*a*. The second interface assembly 116 is disposed at the second end 112*b* and electrically connected to the first interface assembly 114.

The storage unit 130 is, for example, a flash memory storage unit which can be composed as a system integration package model using plastic, metal, ceramic material or epoxy resin with a System In Package (SIP) technology. This allows related control elements, storage elements and circuit boards (not illustrated in the present exemplary embodiment) to be packaged together so as to protect electronic elements within a package structure, such as a body 132 illustrated with dotted line.

Furthermore, the storage unit 130 butt-jointed to another electronic devices with a third interface assembly 134 configured by the connecting terminal 134*a* exposed outside of the package structure of the storage unit 130 and connecting element 134*b*.

The housing 120 is formed with a first accommodating portion 122 and a second accommodating portion 124 which are different from each other. The storage unit 130 is accommodated in the first accommodating portion 122, and the third interface assembly 134 can be protruded outside the housing 120 from the first accommodating portion 122. Furthermore, the switching module 110 is detachably disposed at the second accommodating portion 124, so that one of the first interface assembly 114 and the second interface assembly 116 is concealed at the housing 120. As shown in FIG. 2, the housing 120 of the present exemplary embodiment further includes an opening 121 located at the second accommodating portion 124. When the switching module 110 is assembled to the second accommodating portion 124 of the housing 120, the first interface assembly 114 is concealed within the housing 120 by passing through the opening 121. In addition, this may also be used by designer as an assembling structure between the switching module 110 and the housing 120. In another exemplary embodiment which is not illustrated, the second interface assembly may be accommodated within the housing by passing through the opening instead.

In the present exemplary embodiment, other than connecting to the other electronic devices with the third interface assembly 134, the electronic device 100 can also connect the other electronic devices by using the first interface assembly 114 of the switching module 110 instead. In other words, the switching module 110 can be regarded as an accessory component of the storage unit 130, which can be accommodated at and carried with the second accommodating portion 124 of the housing 120 when not in use.

In the present exemplary embodiment, the first interface assembly 114 of the switching assembly 110 is embedded, snapped or inserted to the housing 120, such that the switching module 110 can be accommodated at the second accommodating portion 124. However, the present exemplary embodiment is not limited thereto, any method that is capable of achieving an effect of positioning members by interference can be used in the present exemplary embodiment.

When a user detaches the switching module 110 from the second accommodating portion 124, and changes to butt joint the third interface assembly 134 with the second interface assembly 116 as shown in FIG. 3, said effect can be achieved in which the electronic device 100 is changed to connect the other electronic devices with the first interface assembly 114. Based on above, the electronic device 100 of the present exemplary embodiment is capable of connecting to the other electronic devices by switching between different interface assemblies while featuring characteristic in carrying convenience. In addition, one of more preferable conditions for the present exemplary embodiment is that, the switching module 110 accommodated at the second accommodating portion 124 and the housing 120 may have a consistent outline, such that integrity of members can be improved while the electronic device 100 may look nicer.

It should be noted that, the first interface assembly 114 of the present exemplary embodiment is a micro universal serial bus (Micro-USB) plug or a Micro-USB male connector; the second interface assembly 116 is a universal serial bus (USB) socket or a USB female connector; and the third interface assembly 134 is a USB plug and a USB male connector. As such, the user may change connecting interfaces of the electronic device 100 of the present exemplary embodiment based on connector types of the other electronic devices. Nevertheless, types of the interface assembly are not particularly limited in the present exemplary embodiment, namely, any known connector types can be applied.

Figure 4:
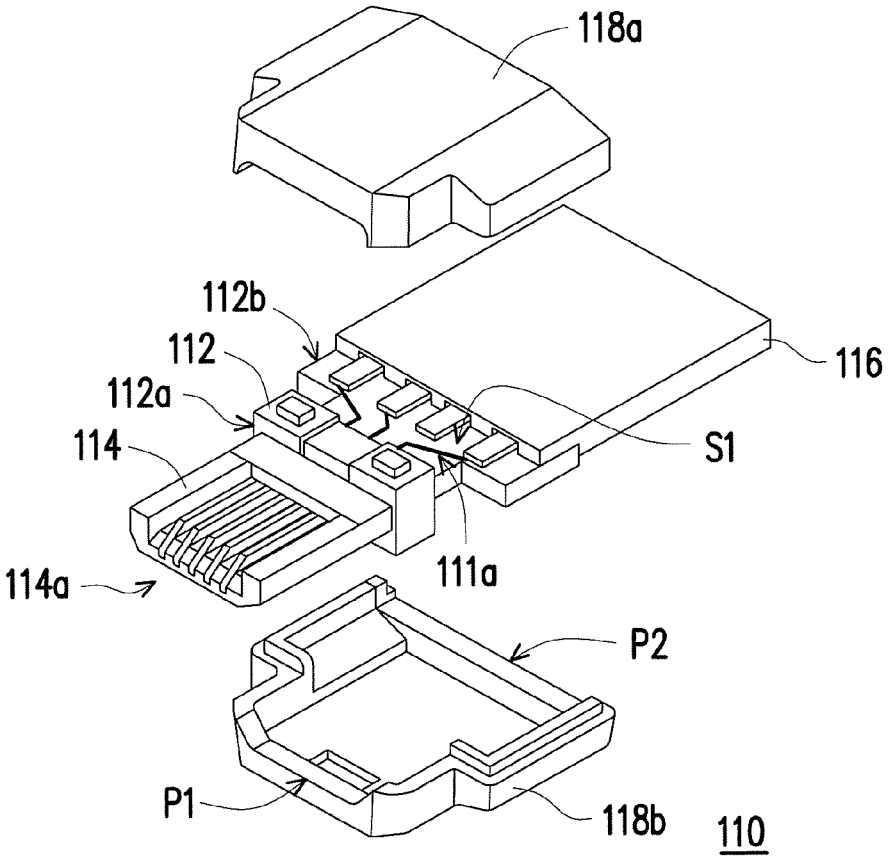
FIG. 4 and FIG. 5 are explosion diagrams illustrating the switching module depicted in FIG. 1 respectively from different perspectives.
Figure 5:
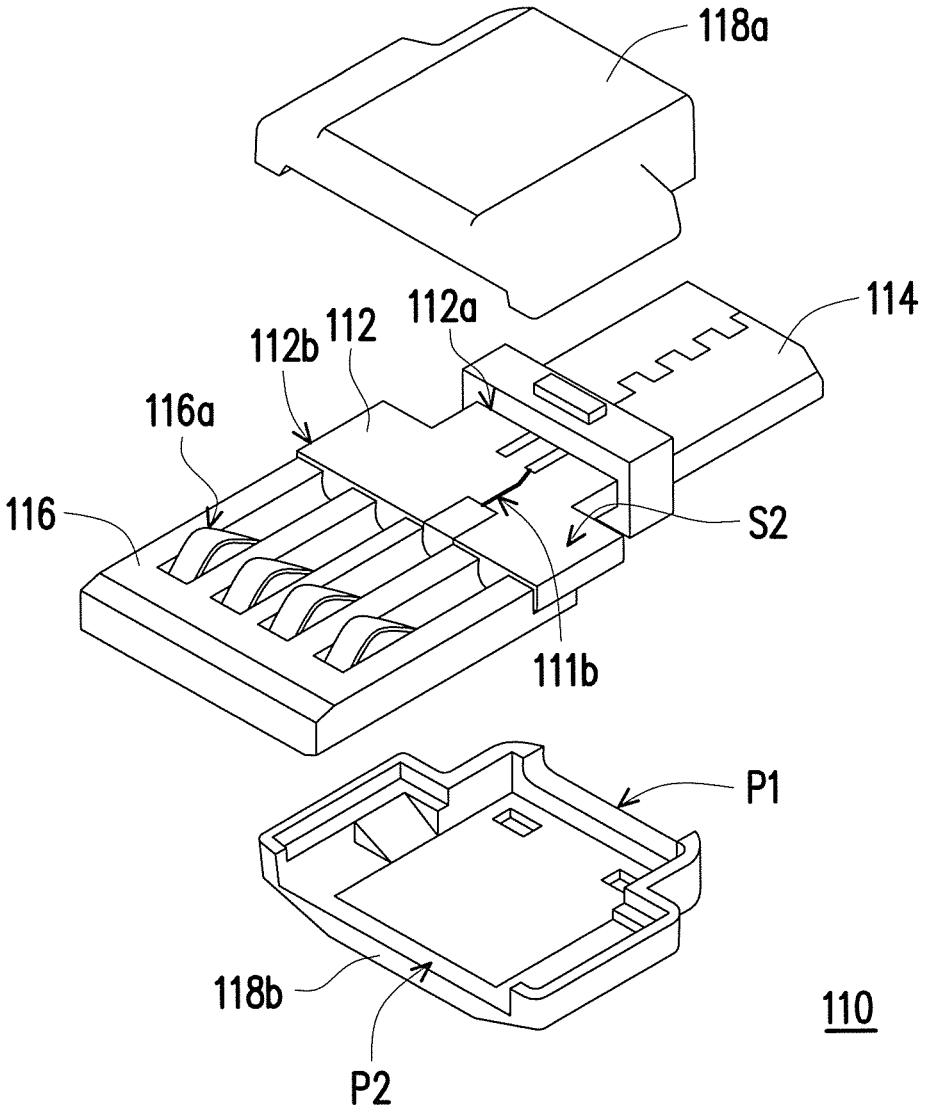

FIG. 4 and FIG. 5 are explosion diagrams illustrating the switching module depicted in FIG. 1 respectively from different perspectives. Referring to FIG. 4 and FIG. 5 together, in the present exemplary embodiment, the body 112 of the switching module 110 has a first surface S1 and a second surface S2 facing away from each other, and the switching module 110 further includes a housing 118, which is assembled at the body 112 and covered on the first surface S1 and the second surface S2 with a first portion 118*a* and a second portion 118*b* arranged in a up-and-down corresponding fashion.

Furthermore, the first portion 118*a* and the second portion 118*b* are assembled at the body 112 to form the housing 118 having a pair of lateral openings P1 and P2 (wherein P1 and P2 are marked at the second portion 118*b* in the figure as an example), such that the first interface assembly 114 and the second interface assembly 116 can be protruded outside the housing 118 respectively through the lateral openings P1 and P2. That is, a terminal set 114*a* of the first interface assembly 114 and a terminal set 116*a* of the second interface assembly 116 are not covered by the housing 118. Accordingly, the switching module 110 may further achieve an effect of weight-lightening and size-controlled.

Figure 6:
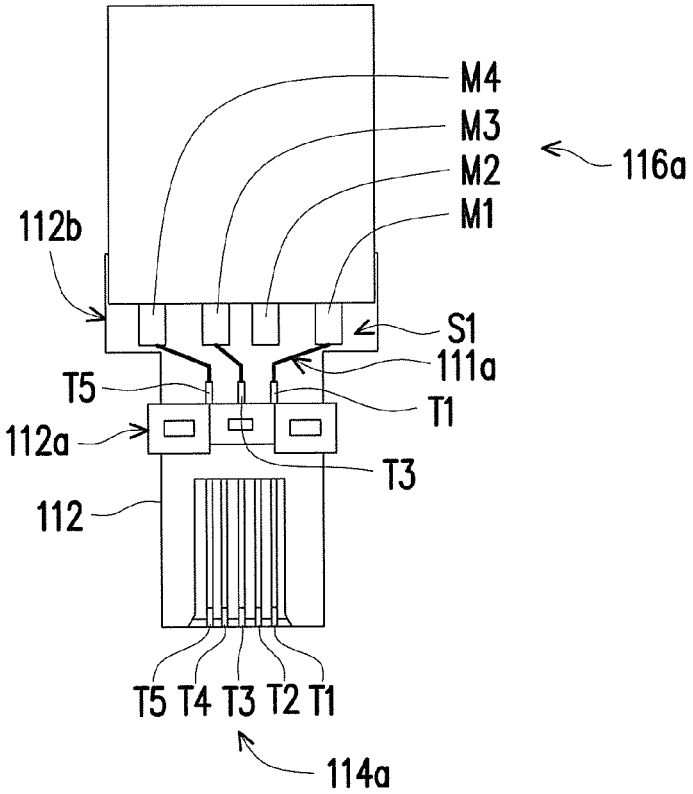
FIG. 6 and FIG. 7 are top views illustrating the switching module respectively from different surfaces.
Figure 7:
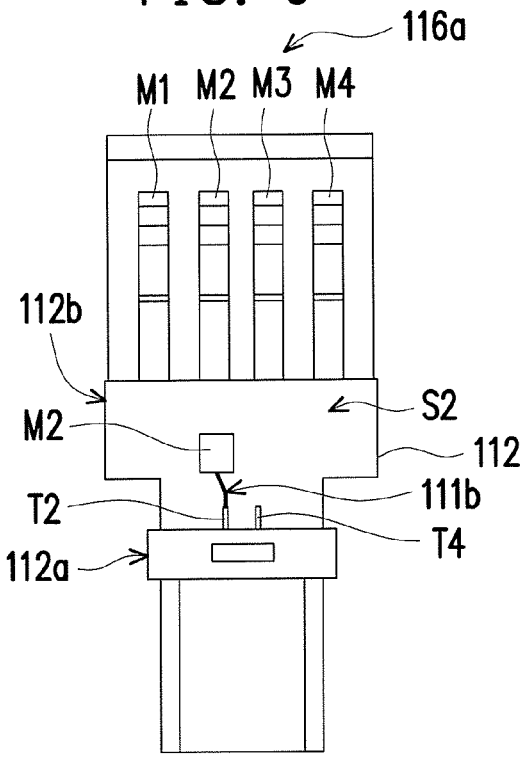

FIG. 6 and FIG. 7 are top views illustrating the switching module respectively from different surfaces. Referring to FIG. 4 to FIG. 7 together, in order to achieve the effect of weight-lightening and size-controlled as described above, the present exemplary embodiment further restricts a connecting relation between the first interface assembly 114 and the second interface assembly 116, in which connecting circuits 111*a* and 111*b* of the switching module 110 are disposed at the first surface S1 and the second surface S2 of the body 112, respectively The housing 118 is assembled and covered on the body 112 and the connecting circuits 111*a* and 111*b* thereon, so that the first interface assembly 114 far away from end portions of the connecting circuits 111*a* and 111*b* and the second interface assembly 116 far away from the end portions of the connecting circuits 111*a* and 111*b* are exposed outside at two opposite sides of the housing 118.

In the present exemplary embodiment, the terminal set 114*a* includes a power terminal T1 (VBUS), a pair of signal terminals T2 and T3 (D+/D−), a product identification terminal T4 (ID) and a ground terminal T5 (GND), and the terminal set 116*a* includes a power terminal M1, a pair of signal terminals M2 and M3, and a ground terminal M4, but the invention is not limited thereto. The terminals T1, T3 and T5 on the first surface S1 are correspondingly connected to the terminals M1, M3 and M4 of the terminal set 116*a*, respectively, through the connecting circuit 111*a*, whereas on the second surface S2, the terminal T2 of the terminal set 114*a* is correspondingly connected to the terminal M2 of the terminal set 116*a* through the connecting circuit 111*b*.

Accordingly, the connecting circuits 111*a* and 111*b* may effectively utilize the first surface S1 and the second surface S2, so as to reduce area required and achieve the effect of weight-lightening and size-controlled. In other words, since the terminal sets 114*a* and 116*a* respectively include different numbers of the terminals, thus only a part of the terminals of the terminal set 114*a* is correspondingly connected to the terminals of the terminal set 116*a*. Method for butt-jointing the terminal sets are not particularly limited herein, it is depended upon the types of the first interface assembly 114 and the second interface assembly 116. In other words, in the present exemplary embodiment, at least one terminal of the first interface assembly 114 (e.g., the product identification terminal T4) is disconnected with each terminal (M1 to M4) of the second interface assembly 116.

In another embodiment which is not illustrated, a pair of terminals electrically connected to each other in the terminal set may be an integrally formed structure. In other words, the first interface assembly and the second interface assembly have the same body on which the terminals integrally formed are supported, and two opposite ends of the terminals are respectively formed as the terminal sets 114*a* and 116*a* according to the forgoing embodiment. Accordingly, the switching module may omit said body and said connecting circuit, so as to achieve further effectiveness in slimming and lightening.

Figure 8:
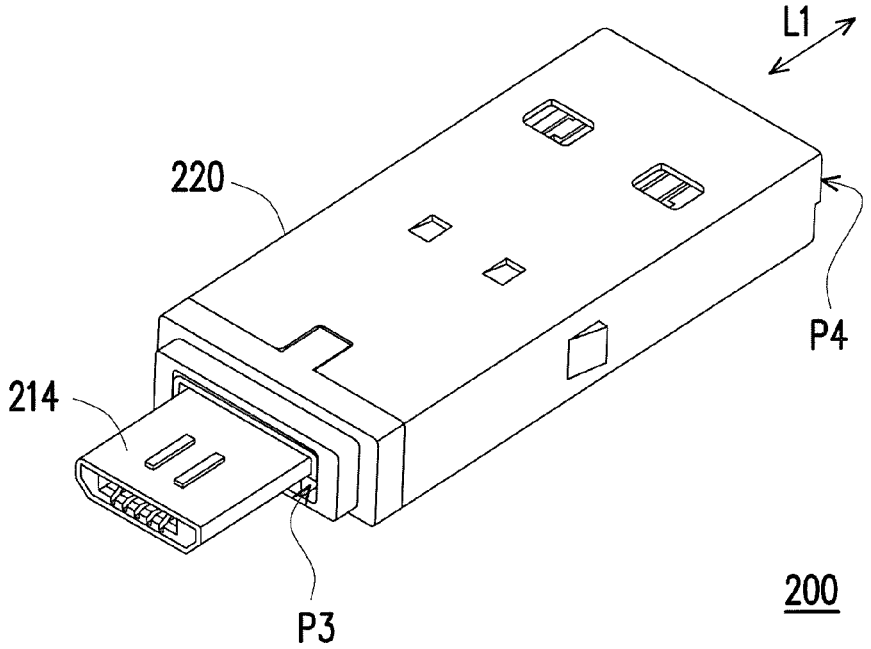
FIG. 8 is a schematic diagram of an electronic device according to another exemplary embodiment of the invention.
Figure 9:
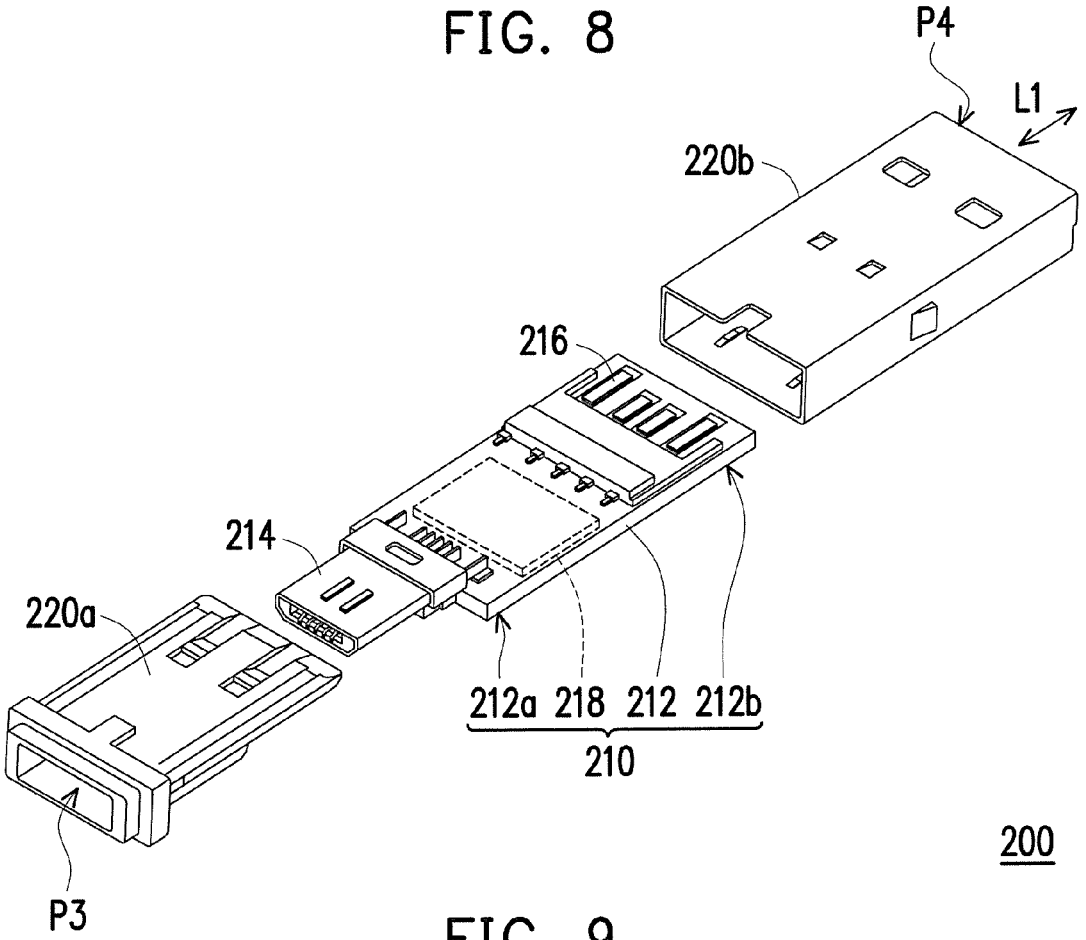
FIG. 9 is an explosion diagram of the electric device depicted in FIG. 8.

FIG. 8 is a schematic diagram of an electronic device according to another exemplary embodiment of the invention. FIG. 9 is an explosion diagram of the electric device depicted in FIG. 8. Referring to FIG. 8 and FIG. 9, in the present exemplary embodiment, an electronic device 200 includes a switching module 210 and a housing 220, in which the switching module 210 further includes a storage unit 218 disposed on a body 212 and electrically connected between a first interface assembly 214 and a second interface assembly 216. In other words, the switching module 210 is similar to the flash memory storage unit as described above, in which related electronic elements are packaged within the body 212, and the second interface assembly 216 is exposed outside at a second end 212*b* of the body 212, and the first interface assembly 214 is disposed at a first end 212*a* of the body 212. Next, a first portion 220*a* of the housing 220 and a second portion 220*b* of the housing 220 are assembled along a butt-jointing axis L1 to accommodate the switching module 210 therein, so as to form the electronic device 200.

The housing 220 has a pair of lateral openings P3 and P4, in which the second interface assembly 216 is exposed outside the lateral opening P4, and the first interface assembly 214 is protruded outside the housing 220 through the lateral opening P3. Accordingly, the electronic device 200 of the present exemplary embodiment forms a flash disk including different interface assemblies structurally, which is adaptable for connecting to other electronic devices with different interfaces. Similarly, types of the interface assemblies are not particularly limited herein.

Figure 10:
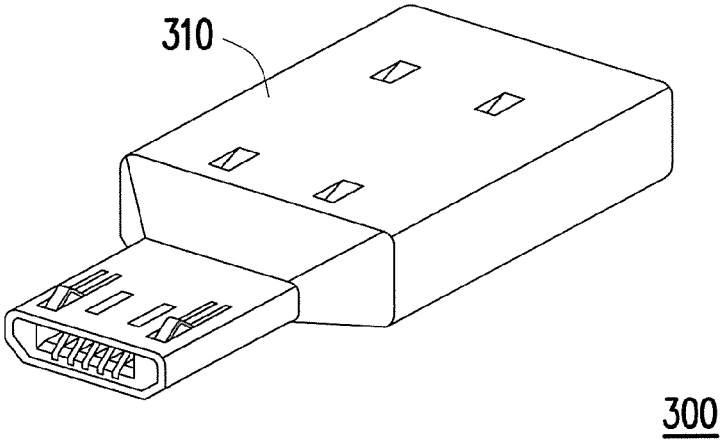
FIG. 10 is a schematic diagram of an electronic device according to another exemplary embodiment of the invention.
Figure 11:
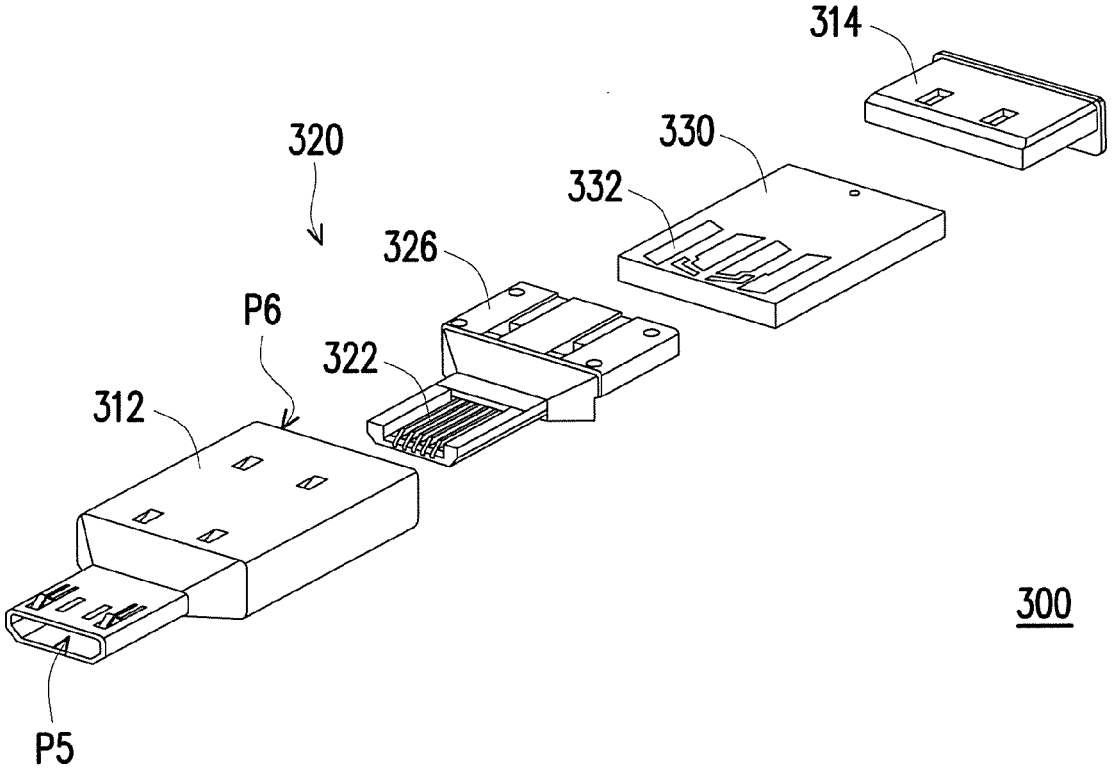
FIG. 11 is an explosion diagram of the electric device depicted in FIG. 10.
Figure 12:
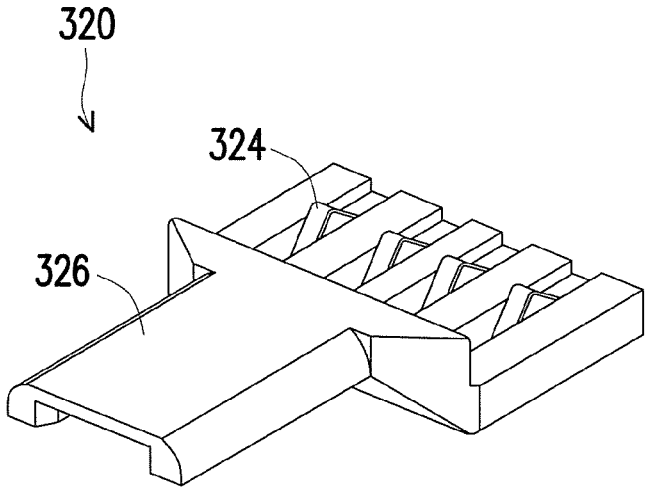
FIG. 12 is a schematic diagram of the switching module depicted in FIG. 11 from another perspective.
Figure 13:
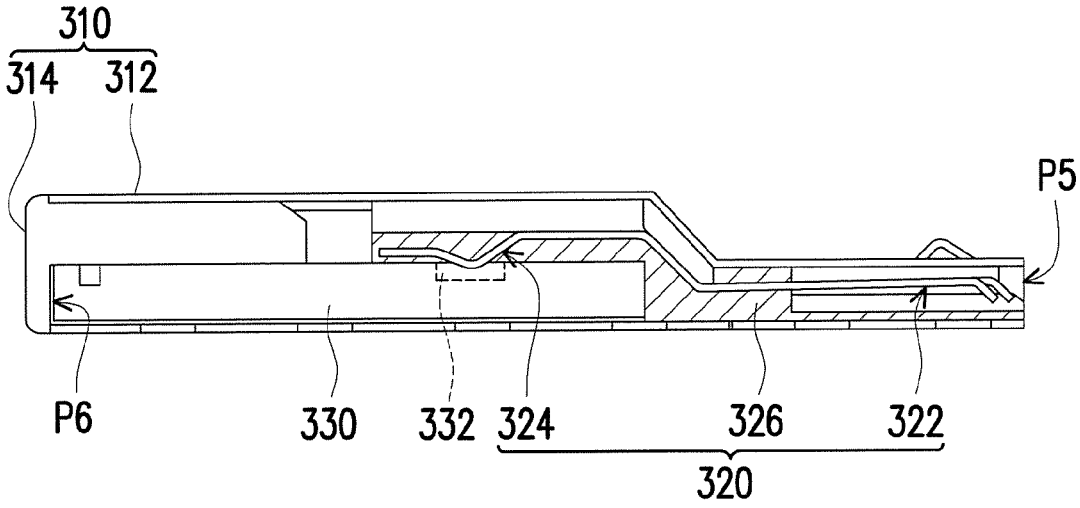
FIG. 13 is a sectional view of the electric device depicted in FIG. 10.

FIG. 10 is a schematic diagram of an electronic device according to another exemplary embodiment of the invention. FIG. 11 is an explosion diagram of the electric device depicted in FIG. 10. FIG. 12 is a schematic diagram of the switching module depicted in FIG. 11 from another perspective. FIG. 13 is a sectional view of the electric device depicted in FIG. 10. Referring FIG. 10 to FIG. 13 together, in the present exemplary embodiment, an electronic device 300 includes a housing 310, a switching module 320 and a storage unit 330, in which the switching module 320 is similar to the switching module 130 described above. That is, it also includes a body 326, a first interface assembly 322 and a second interface assembly 324 disposed together on the body 326 and electrically connected to each other, and the first interface assembly 322 and the second interface assembly 324 of the present exemplary embodiment are of an integrally formed structure (as shown in FIG. 13). The storage unit 330 has a third interface assembly 332 which is suitable to be propped against the second interface assembly 324 to electrically connect to the first interface assembly 322. As shown in FIG. 13, the third interface assembly 332 is actually propped against between the second interface assembly 324 and a bottom side of a first portion 312 of the housing 310.

In addition, the first portion 312 of the housing 310 has a pair of lateral openings P5 and P6. The switching module 320 and the storage unit 330 are placed within the first portion 312 from the lateral opening P6, and a second portion 314 of the housing 310 is packaged at the lateral opening P6, so that the first interface assembly 322 is exposed outside the housing 310 from the lateral opening P5. The third interface assembly 332 of the storage unit 330 is electrically connected to the second interface assembly 324 through one of the lateral openings (P6), and a host (not illustrated) is electrically connected to the first interface assembly 322 through another one of the lateral openings (P5). Accordingly, the switching module 320 and the storage unit 330 can be accommodated within the housing 310, so as to form the electronic device 300 with functionalities of a flash drive.

In the present exemplary embodiment, types of the first interface assembly 322, the second interface assembly 324 and the third interface assembly 332 are identical to that of the previous embodiments and not particularly limited either. That is, the storage unit 330 originally included with a universal serial bus connecting interface may be changed due to the switching module 320 to include a micro universal serial bus connecting interface instead, so as to improve adaptability of the storage unit 330.

Figure 14:
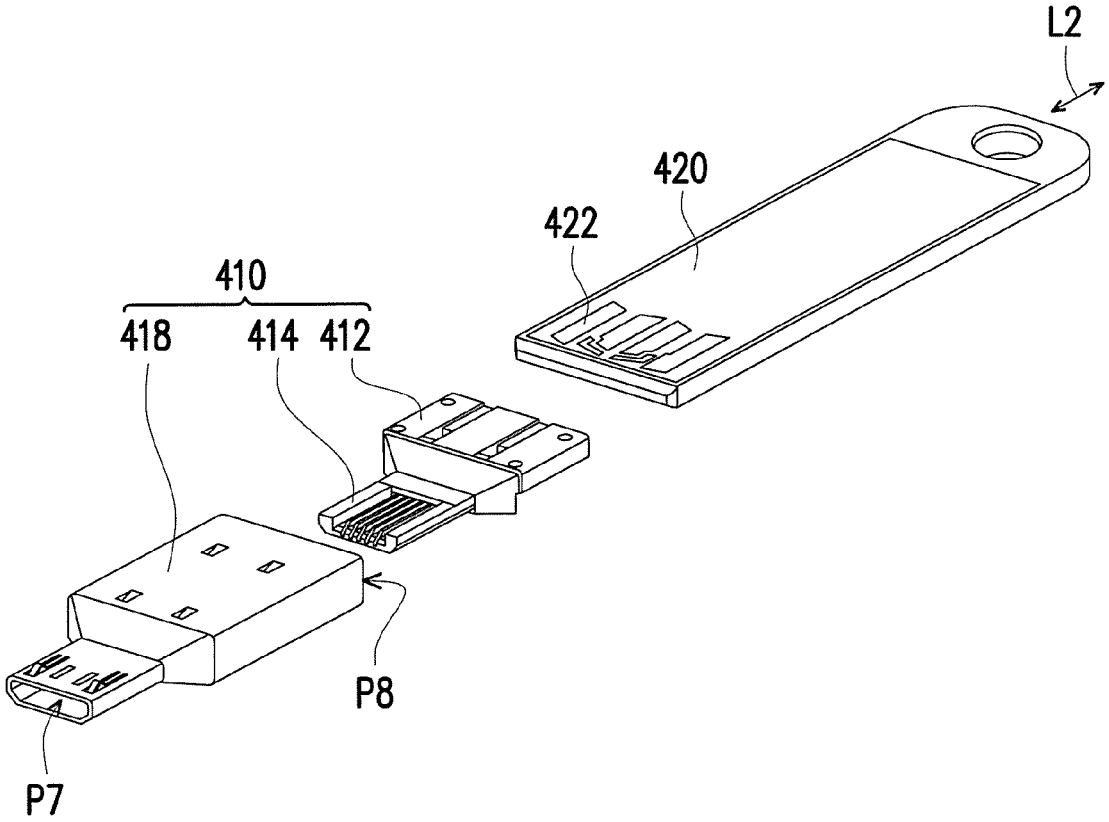
FIG. 14 and FIG. 15 are schematic diagrams of an electronic device according to another exemplary embodiment of the invention.
Figure 15:
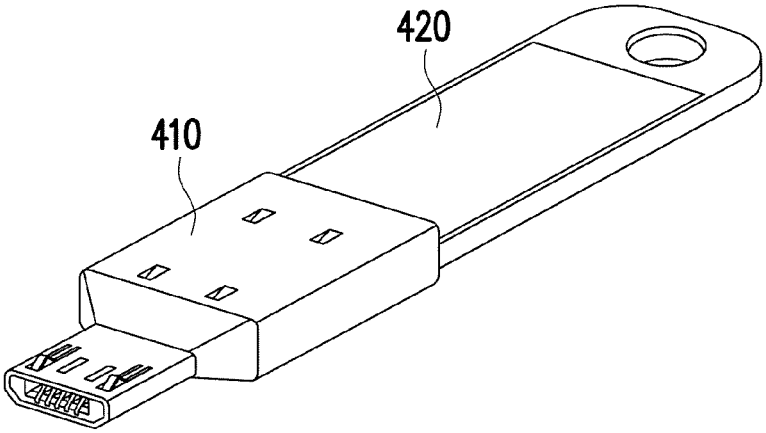

FIG. 14 and FIG. 15 are schematic diagrams of an electronic device according to another exemplary embodiment of the invention. What is different from the above embodiments is that, an electronic device 400 of the present exemplary embodiment includes a switching module 410 and a storage unit 420. What is similar to the above embodiments is that, the switching module 410 includes a body 412, a first interface assembly 414 and a second interface assembly (which is not illustrated herein for it is disposed at another side of the body 412, but it can refer to the structure as illustrated in FIG. 12) assembled on the body 412, and a housing 418 configured to accommodate the body 412 and the first interface assembly 414. The storage unit 420 has a third interface assembly 422 exposed to the outside.

In addition, the housing 418 has a pair of lateral openings P7 and P8. The first interface assembly 414 of the switching module 410 is exposed outside at the lateral opening P7 of the housing 418, and the storage unit 420 is pluggably inserted at the lateral opening P8 along an assembling axis L2, so as to be propped against together with the second interface assembly. Among them, the third interface assembly 422 of the storage unit 420 is electrically connected to the second interface assembly through one of the lateral openings (P8), and a host (not illustrated) is electrically connected to the first interface assembly 414 through another one of the lateral openings (P7). Accordingly, the third interface assembly 422 of the storage unit 420 is thereby electrically connected to the first interface assembly 414. This not only allows the storage unit 420 to change the connecting interfaces, but also provides a replaceablity for the storage unit 420 because of its plugability.

Figure 16A:
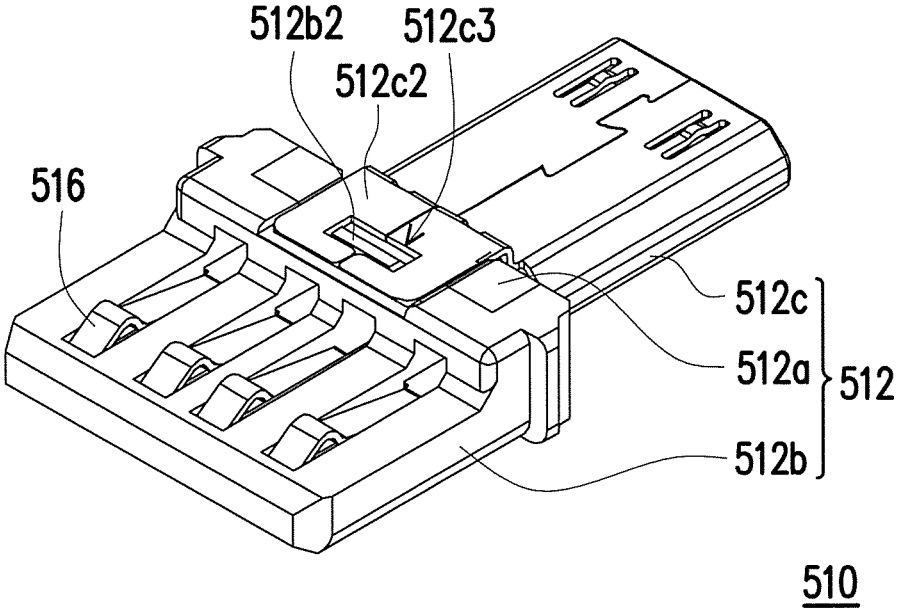
FIG. 16A is a schematic diagram of a switching module according to another exemplary embodiment of the invention.
Figure 16B:
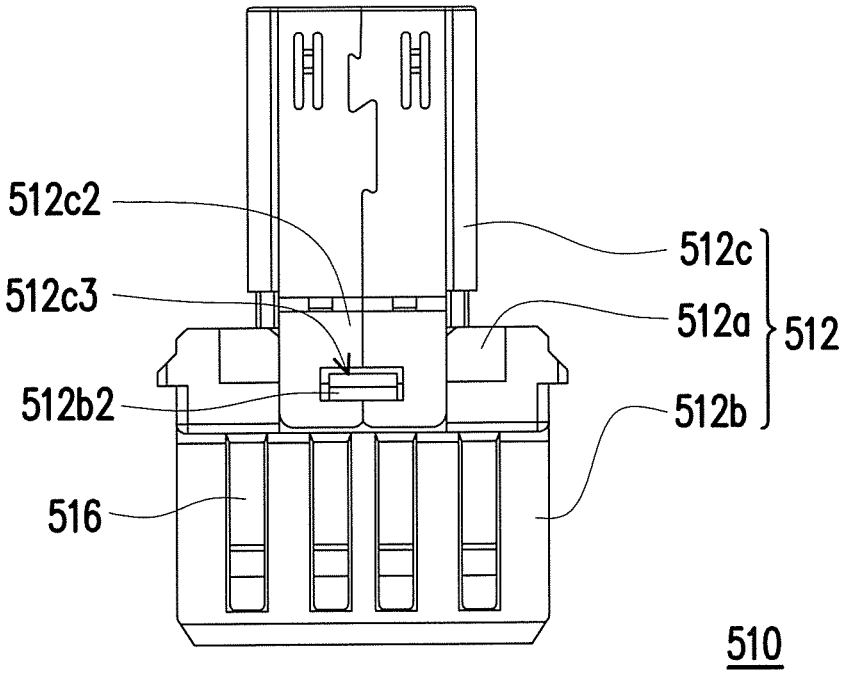
FIG. 16B is a top view illustrating the switching module depicted in FIG. 16A.
Figure 16C:
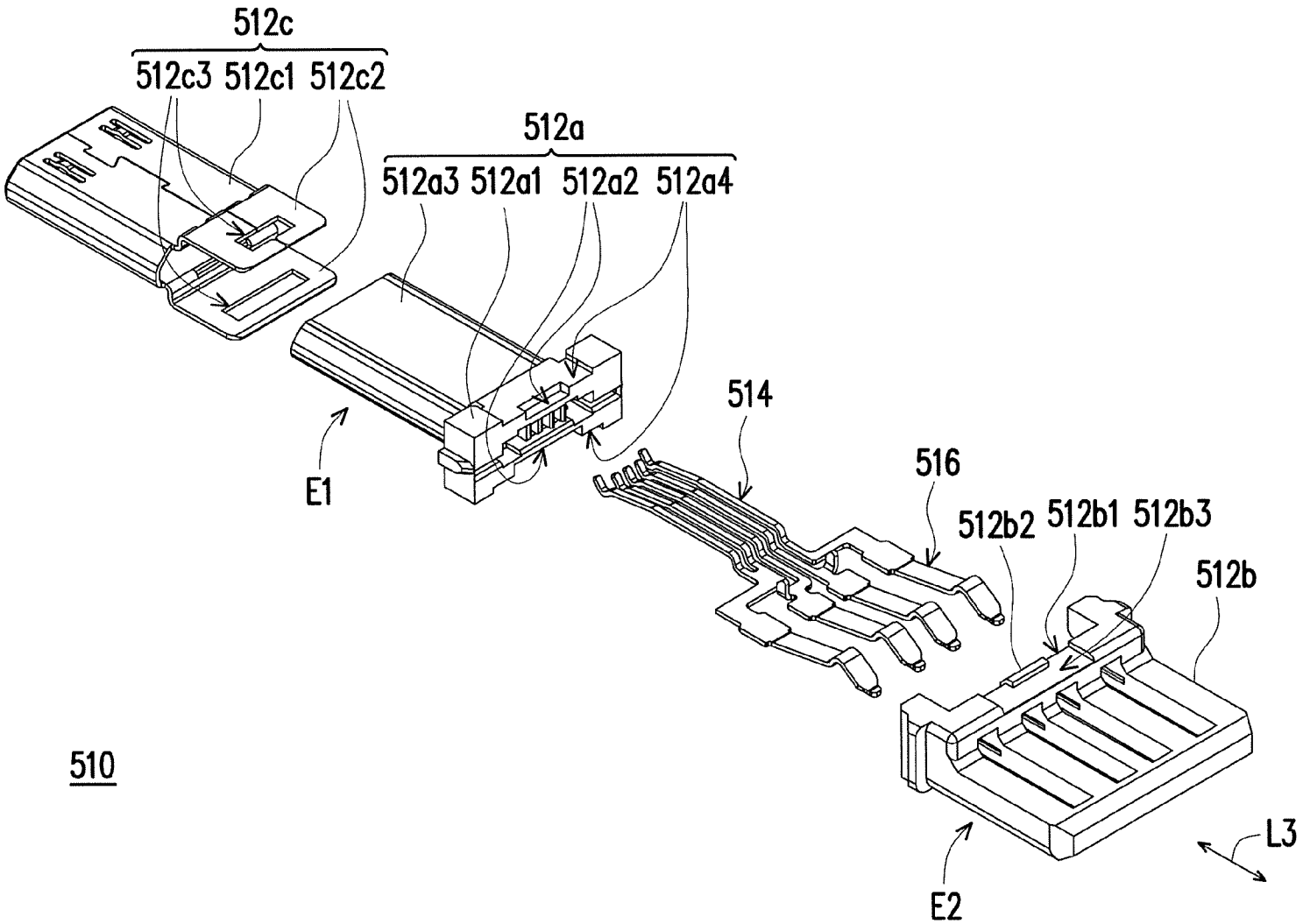
FIG. 16C is an explosion diagram illustrating the switching module depicted in FIG. 16A.

FIG. 16A is a schematic diagram of a switching module according to another exemplary embodiment of the invention. FIG. 16B is a top view illustrating the switching module depicted in FIG. 16A. FIG. 16C is an explosion diagram illustrating the switching module depicted in FIG. 16A. Referring to FIGS. 16A-16C and comparing with the exemplary embodiment of the switching module 110 in FIG. 5, the switching module 510 of the present exemplary embodiment includes a body 512, a first interface assembly 514, and a second interface assembly 516. The body 512 includes a first supporting member 512*a* having a first end E1, a second supporting member 512*b* having a second end E2, and a locking member 512*c*, wherein the first interface assembly 514 and the second interface assembly 516 are configured at the first end E1 of the first supporting member 512*a* and the second end E2 of the second supporting member 512*b*.

In the exemplary embodiment, the first interface assembly 514 and the second interface assembly 516 are integrally formed, such that the body 112 of the exemplary embodiment in FIG. 5 above is ignored in the exemplary embodiment of FIG. 16A~FIG. 16C. Furthermore, the first interface assembly 514 is inserted into the first supporting member 512*a*, and the second interface assembly 516 passes through the second supporting member 512*b* and is exposed outside of the second supporting assembly 512*b* along an axis L3.

The second supporting member 512*b* has a concave portion 512*b*1, and the first supporting member 512*a* has a protruding portion 512*a*1 used for being buckled into the concave portion 512*b*1 along the axis L3 correspondingly, such that the first supporting member 512*a* and the second supporting member 512*b* are assembled together, and the first interface assembly 514 and the second interface assembly 516 are received therein.

Besides, the first supporting member 512*a* also has notches 512*a*2 located at a top-center and a bottom-center of the protruding portion 512*a*1, and the second supporting member 512*b* has a interfering block 512*b*2 located at a center of the concave portion 512*b*1. Referring to FIG. 16C, only one interfering block 512*b*2 on top-center of the second supporting member 512*b* is shown for a representative, wherein another interfering block 512*b*2 on bottom-center of the second supporting member 512*b* is not depicted in FIG. 16C. When the first supporting member 512*a* and the second supporting member 512*b* are assembled together by the protruding portion 512*a*1 being buckled in the concave portion 512*b*1, the interfering block 512*b*2 is received in the notch 512*a*2.

In the exemplary embodiment, the locking member 512*c* has a shielding case 512*c*1 and a pair of elastic pieces 512*c*2, wherein a main portion 512*a*3 of the first supporting member 512*a* is sheathed in the shielding case 512*c*1 closely for shielding the first interface assembly 514 therein. The elastic pieces 512*c*2 are extended along the axis L3 and arranged in an up-and-down manner relative to the first supporting member 512*a* and the second supporting member 512*b*. Correspondingly, the first supporting member 512*a* has a pair of troughs 512*a*4 and the second supporting member 512 has a pair of troughs 512*b*3 (only one trough 512*b*3 of the second supporting member 512*b* is shown in FIG. 16C for a representative). Accordingly, the elastic pieces 512*c*2 clamp the troughs 512*a*4, 512*b*3 of the first supporting member 512*a* and the second supporting member 512*b* so as to assemble the first and the second supporting members 512*a*, 512*b* together.

In the exemplary embodiment, the locking member 512*c* has a pair of openings located on the elastic pieces 512*c*2 respectively. When the first supporting member 512*a*, the second supporting member 512*b*, and the locking member 512*c* are assembled, the elastic pieces 512*c*2 extended toward the second supporting member 512*b* clamp the toughs 512*a*4, 512*b*3 with the interfering blocks 512*b*2 being interfered with the elastic pieces 512*c*2 in the openings 512*c*3, such that the locking member 512*c* and second supporting member 512*b* are locked with each other and the first supporting member 512*a* is clamped therebetween.

In view of above, according to the embodiments of the invention, the electronic device using the switching module is adaptable for other electronic devices having different interfaces. In one of the exemplary embodiments, the switching module may be accommodated within the electronic device as an accessory. Further, in another exemplary embodiment, the storage unit may also be disposed with connectors with different interfaces at the same time. In addition, the switching module is capable of being assembled and detached together with the storage unit based on actual requirements. Accordingly, with collocation of the storage unit and the switching module, portability and adaptability of the electronic device can be effectively improved.

Although the invention has been described with reference to the embodiments thereof, it will be apparent to one of the ordinary skills in the art that modifications to the described embodiments may be made without departing from the spirit of the invention. Accordingly, the scope of the invention will be defined by the attached claims not by the above detailed description.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device, comprising:

a switching module having a first interface assembly and a second interface assembly electrically connected to each other; and a storage unit having a third interface assembly, wherein the second interface assembly and the third interface assembly are corresponding to each other so that the third interface assembly is butt-jointed to the second interface assembly and then electrically connected to the first interface assembly, wherein the storage unit is a system integration package (SIP) and the third interface assembly is an universal serial bus plug, wherein at least one terminal of the first interface assembly correspondingly connects to at least one terminal of the second interface assembly to integrally form a terminal pin, and a pair of the at least one terminals connected to each other of the first interface assembly and the second interface assembly are opposite ends of the terminal pin, wherein the switching module comprises:

a body having a first end and a second end opposite to each other, the first interface assembly being disposed at the first end and the second interface assembly being disposed at the second end;

a first housing having a first portion and a second portion, the first portion having a pair of lateral openings opposite to each other and accommodating the body, the first interface assembly, the second interface assembly, and the entire storage unit, wherein the third interface assembly of the storage unit is configured to electrically connect the second interface assembly through one of the pair of lateral openings and the second portion is packaged at one of the pair of lateral openings, and a host is configured to electrically connect the first interface assembly through another one of the pair of lateral openings, the third interface assembly is propped against between the second interface assembly and a bottom side of the first portion, such that the switching module and the SIP storage unit are integrated into one single unit, and there is no metal housing surrounded the second interface and located between the first housing and the third interface assembly when the third interface is butt-jointed to the second interface assembly.

2. The electronic device of claim 1, wherein the first interface assembly is a micro universal serial bus plug.

3. The electronic device of claim 1, wherein the second interface assembly is a universal serial bus socket.

4. The electronic device of claim 1, wherein the storage unit is accommodated within the first housing and the third interface assembly is located between the second interface assembly and a bottom side of the first housing and propped against the second interface assembly.

5. The electronic device of claim 1, wherein the third interface assembly of the storage unit is pluggably and electrically connected to the second interface assembly through the lateral openings of the first housing.

6. The electronic device of claim 1, wherein at least one terminal of the first interface assembly is disconnected with each terminal of the second interface assembly.

7. The electronic device of claim 1, wherein the first interface assembly includes a power terminal (VBUS), a pair of signal terminals (D+/D−), a product identification terminal (ID) and a ground terminal (GND).

8. The electronic device of claim 1, wherein the second interface assembly includes a power terminal (VBUS), a pair of signal terminals (D+/D−) and a ground terminal (GND).

9. The electronic device of claim 1, wherein the switching module further includes a body, and the body comprises:

a first supporting member having the first end;

a second supporting member assembling to the first supporting member and having an interfering block and the second end;

a locking member having a shielding case, an elastic piece extended from the shielding case, and an opening located on the elastic piece, wherein the locking member and the second supporting member are assembled to the first supporting member in opposite directions, wherein a part of the first supporting member is sheathed in the shielding case, the elastic piece extends toward the second supporting member, and the interfering block is interfered in the opening of the elastic piece, such that the second supporting member and the locking member are locked with each other to assembled the first supporting member therebetween.

10. The electronic device of claim 9, wherein the second supporting member has a concave portion that the interfering block located at a center of the concave portion, and the first supporting member has a protruding portion and a notch located at a center of the protruding portion, wherein the first and the second supporting members are assembled to each other by the protruding portion being buckled in the concave portion, and the interfering block is received in the notch.

11. The electronic device of claim 9, wherein the locking member has a pair of elastic pieces, and each of the first supporting member and the second supporting member has a pair of clamping troughs, wherein the elastic pieces clamp the troughs of the first and the second supporting members so as to assembled the first and the second supporting members together.

* * * * *